United States Patent [19]

Albert et al.

[11] 4,287,681

[45] Sep. 8, 1981

[54] TOY DOLL AND ACCESSORY

[75] Inventors: Judith Albert, Mill Neck, N.Y.; Robert E. Davis, North Branford, Conn.

[73] Assignee: Ideal Toy Corporation, Hollis, N.Y.

[21] Appl. No.: 126,137

[22] Filed: Feb. 29, 1980

[51] Int. Cl.[3] ..... A63H 29/16

[52] U.S. Cl. ..... 46/44; 46/116; 46/107

[58] Field of Search ..... 46/44, 116, 107, 118, 46/119, 120, 123

[56] References Cited

U.S. PATENT DOCUMENTS

| | | | |
|---|---|---|---|
| 2,310,781 | 2/1943 | Harris | 46/107 |
| 2,726,481 | 12/1955 | Sebel | 46/116 X |
| 3,141,261 | 7/1964 | Mirando | 46/118 |
| 3,740,893 | 6/1973 | Shinoda | 46/44 |
| 3,757,463 | 9/1973 | Breslow et al. | 46/118 |
| 4,057,928 | 11/1977 | Terzian | 46/118 X |
| 4,124,952 | 11/1978 | Terzian | 46/44 |
| 4,158,931 | 6/1979 | Terzian | 46/118 |

FOREIGN PATENT DOCUMENTS

| | | | |
|---|---|---|---|
| 145361 | 1/1950 | Australia | 46/116 |
| 612922 | 11/1960 | Italy | 46/107 |

*Primary Examiner*—Gene Mancene
*Assistant Examiner*—Mickey Yu
*Attorney, Agent, or Firm*—Richard M. Rabkin

[57] ABSTRACT

A combination doll and accessory is provided in which the doll has an articulated limb mounted for movement relative to the doll's torso and pneumatically actuated bellows in the body for moving the limb upon application of pressure to an air reservoir contained in the doll's body. An accessory for use with the doll, for example a carriage, includes a second air reservoir and a conduit which can be connected to the air reservoir in the doll's body through a selectively operable valve. When the doll is connected to the accessory the articulated limb can be actuated by either squeezing the doll or the air reservoir on the carriage.

8 Claims, 7 Drawing Figures

FIG. 1
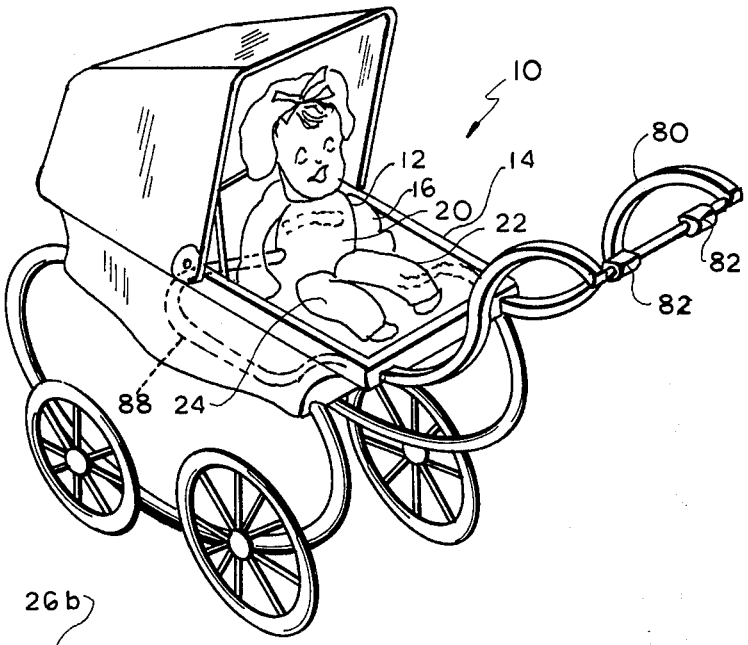
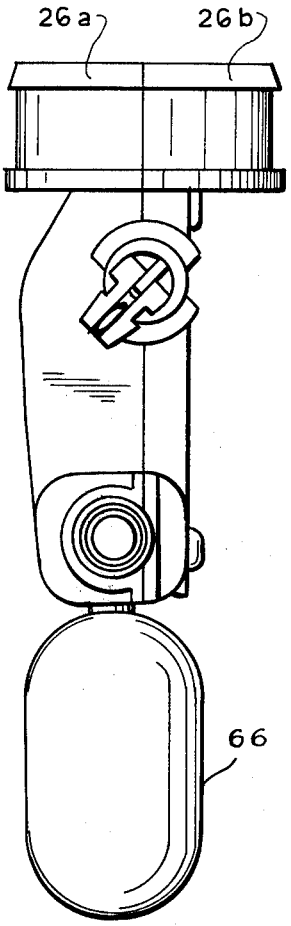
FIG. 4
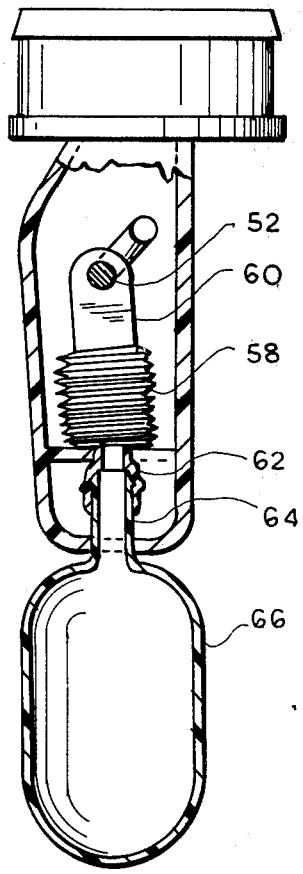
FIG. 5

TOY DOLL AND ACCESSORY

In accordance with an aspect of the present invention a combination doll and accessory is provided which includes a doll's body having a torso and at least one articulated limb mounted on the body for movement relative to the body's torso. A pressure responsive actuator such as, for example a bellows is located within the body and connected to the doll's articulated limb to move that limb relative to the torso upon application of pressure to the bellows. A flexible fluid reservoir is also located in the body, for example, in its torso, in fluid communication with the bellows so that upon squeezing of the body adjacent the reservoir pressure will be applied to the bellows in order to move the articulated limb.

It is noted that the term fluid as used herein is intended to encompass both gases, such as air, and liquids, such as water. However, air is the preferred fluid actuating medium used in the doll.

The fluid or reservoir in the doll has an outlet opening to the exterior of the doll's body which is selectively opened and closed by a removable cap valve. An accessory for the doll is also provided which, in the illustrative embodiment, takes the form of a carriage includes a second fluid reservoir mounted on the carriage handlebar. The second reservoir is connected through a flexible tube to the reservoir in the doll's body through the valve. By this arrangement the articulated limb of the doll can be selectively actuated by application of pressure to either the reservoir on the carriage or to the reservoir in the doll's body.

The above, and other objects, features and advantages of this invention will be apparent in the following detailed description of an illustrative embodiment thereof, which is to be read in connection with the accompanying drawings, wherein:

FIG. 1 is a perspective view of a doll and carriage combination constructed in accordance with the present invention;

Figures 2, 2A:
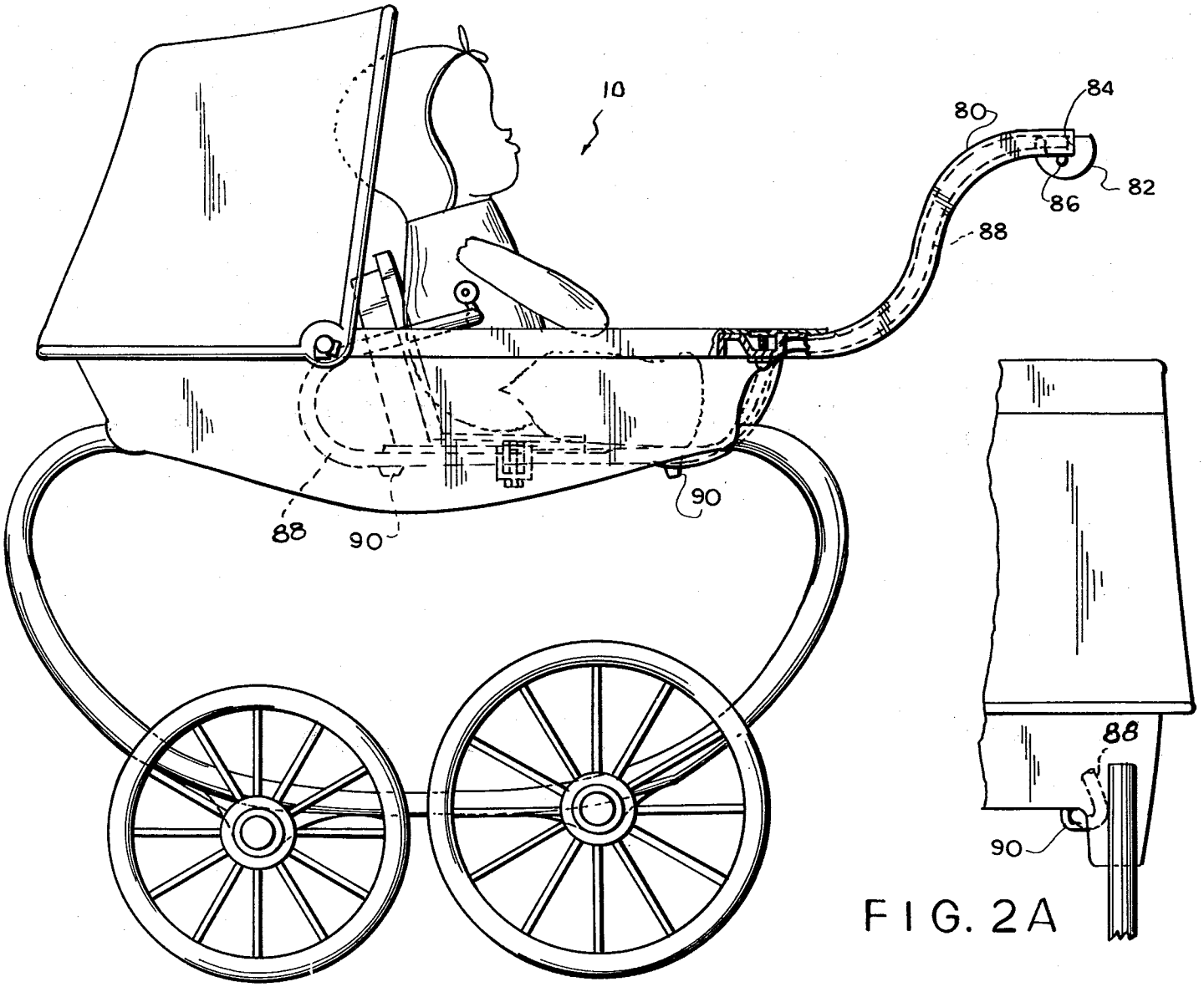
FIG. 2 is a side view, partly in section, showing the connection between the doll and the carriage.
Figure 3A:
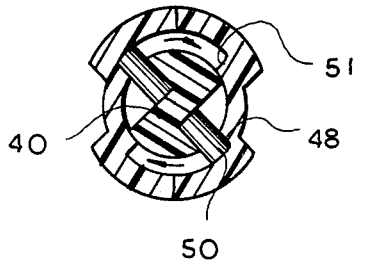
Figure 3:
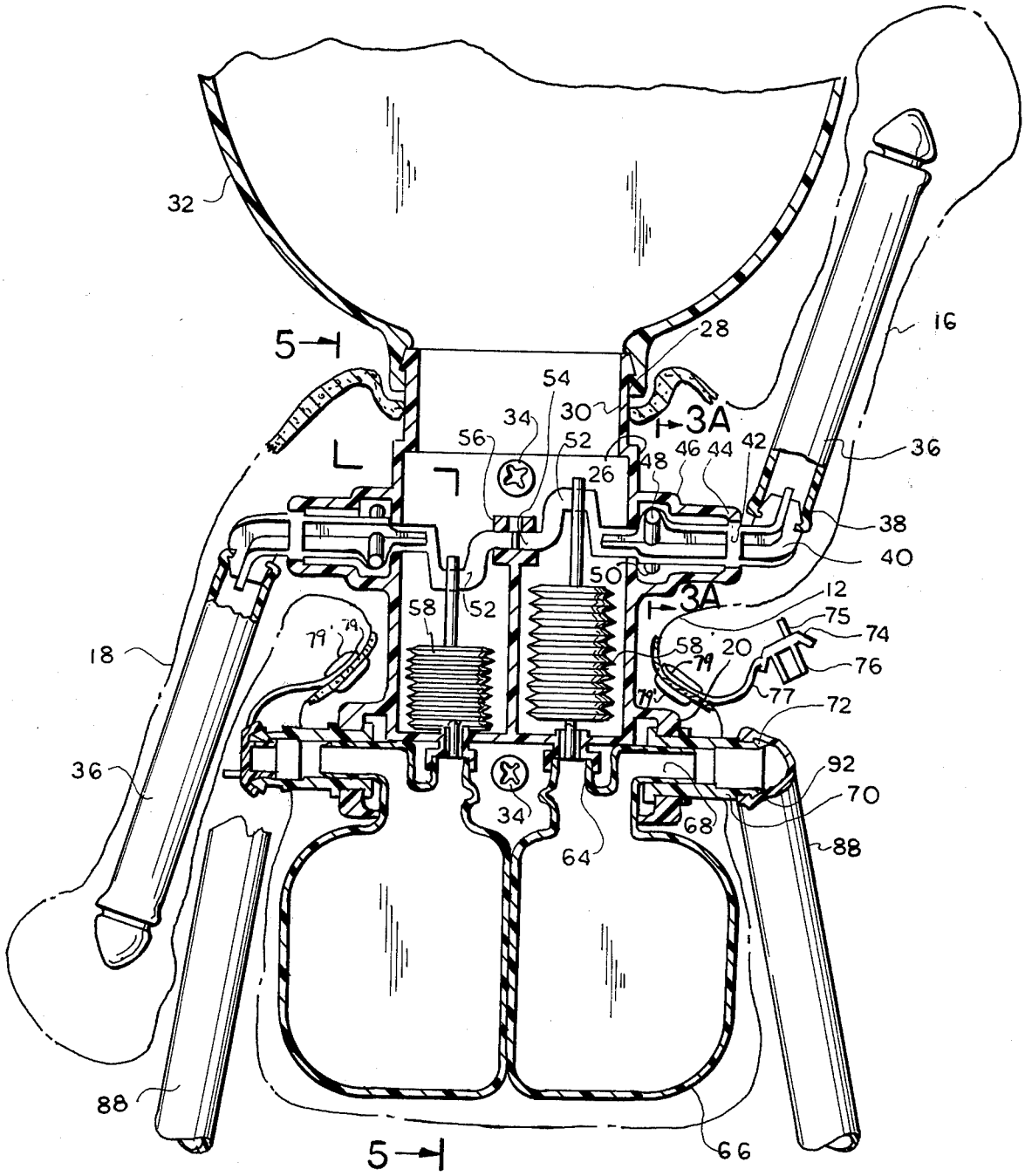

FIG. 2*a* is a rear elevational view taken along the lines 2*a*—2*a* of FIG. 2, showing the passage of the air conduit from the carriage frame into the body of the carriage for connection to the doll;

FIG. 3 is a vertical sectional view of the doll illustrated in FIG. 1;

FIG. 3*a* is a sectional view taken along line 3*a*—3*a* of FIG. 3;

FIG. 4 is a side view of the limb actuating mechanism used in the doll; and

FIG. 5 is a sectional view of the limb actuating mechanism taken along line 5—5 of FIG. 3.

Referring now to the drawing in detail, and initially to FIG. 1 thereof, a combination doll and accessory 10 includes doll 12 and carriage 14. The doll contains a pressure actuated mechanism which will cause one or more limbs of the doll, for example, the arms 16, 18, to move relative to the doll's torso 20 when pressure is applied to a specific portion of the doll's body (for example, the stomach area). In addition, carriage 14 includes pressure responsive members which can be selectively connected to the doll so that by squeezing the handle of the carriage the doll's limbs may also be caused to be moved.

In the illustrative embodiment of the invention the doll's body 12 is formed of stuffed fabric, in the conventional manner, and includes integral arms 16, 18, torso 20 and legs 22, 24, all sewn together from fabric and stuffed with a fiber-filler material. Torso 20 includes a neck or mounting block 26 which has an extension 28 that passes through an upper neck opening 30 in doll's body 12. The doll's head, which is formed of molded plastic in the usual manner, is snap fit on the upper end of neck extension 28.

The neck block or mounting member 26 is formed of two molded plastic elements, 26*a*, 26*b* (see FIG. 4) secured together by screws 4 or the like. The pressure responsive mechanism for actuating the arms 16, 18, of the doll is contained within member 26, as described hereinafter.

Flexible tubular elements or rods 36 are located within each of the doll's arms to give the arms a certain degree of stiffness. The elements are bendable, however, so that mechanism is protected should the child bend the arm. The upper ends 38 of rods 36 are secured to crank members 40 which extend into neck block 26. Each crank member has an integral annular bearing 42 formed thereon which is rotatably received in the end 44 of a bearing tube 46 formed by members 26*a* and 26*b*. In addition, cranks 40 include transverse pins 48 which are captured within chambers 50 of the neck block halves to prevent the cranks, and thus the arm rods from being pulled out of the neck block. Chambers 50 also have shoulders 51 formed therein at approximately 90° from each other to act as stops for pins 48 and thus limit arm motion approximately 90°. See FIG. 3*a*. Finally, each crank includes a U-shaped crank portion 52 and a free end 54 which is rotatably received in a support block 56 within neck block 26. By this arrangement, arms 16, 18 are articulated on the neck block in the doll's body and can pivot with respect to torso 20.

In FIG. 3 one of the arms is shown in its raised position as a result of the actuation of the pressure responsive mechanism in the doll, while the other arm, 18, is shown in its relaxed unactuated position.

The pressure responsive mechanism used to actuate the doll's arms includes a pair of independently operated bellows 58 located within neck block 26. The bellows are of identical construction, and each is a relatively airtight member formed with accordion pleats in the conventional manner. The bellows has, at its upper end, an integral rigid extension 60 which is pivotally connected to its associated crank 52, as seen in FIG. 5. The lower end of the bellows has an extension tube 62 which is connected through a snap-fit arrangement to the inlet port 64 of an air reservoir 66. The air reservoirs associated with bellows 58 are independent of each other so that arms 16, 18 can be operated independently.

Each air reservoir 66 includes, in addition to inlet 64, an outlet opening or port tube 68. This tube is connected to a valve tube or extension 70 which projects beyond doll's torso 20. The free end 72 of the tube can be selectively opened or closed by a valve cap 74 having an integral plug 76 that is received within tube 72.

The valve plug 74 is secured to the doll's body so that it will not be inadvertently lost or misplaced by an extension 77 whose free end carries a ring 79 that is secured by a grommet 79' to the fabric of the doll's body. The plug may also be provided with a pull tab 75 to aid in removing it from tube 70.

When caps 74 are in position closing tubes 70 the air reservoirs and bellows are sealed. As a result, when either air reservoir is squeezed by the application of pressure to the doll's torso in the area of the reservoir, air is expelled from the reservoir into its associated collapsible bellows 58. As seen in FIG. 3, when the right-hand reservoir is compressed the bellows 58 expands as a result of the increased air pressure therein and causes crank 52 to rotate, thus raising arm 16 to its raised position. When manual pressure on air reservoir 66 is relieved the air in the bellows returns to its associated reservoir and the collapse of the bellows draws arm 16 to its lower position.

In accordance with a feature of the present invention the pressure responsive mechanism for actuating arms 16, 18 in the doll can be connected to the accessory or carriage 14 for operation by a child from a remote location.

In the illustrative embodiment of the present invention, carriage 14 includes a handle bar 80 which is generally channel shaped and has a downwardly facing open channel. Separate air reservoirs 82 are secured to handle bar 80, as seen in FIGS. 1 and 2. These air reservoirs are of flexible plastic construction, similar to that of the air reservoirs 66, and have a channel shaped recess 84 formed therein which enables them to be snap-fit on the channel shaped handle bar 80. In addition, one end of each of the air reservoirs has an extension tube 86 formed therein which permits air to move in and out of the reservoir. This extension is connected to an elongated conduit or tube 88 which is retained within the downwardly facing channel of handle bar 80. Tubes 88 extend (in opposite directions) from each of the reservoirs 82 along handle bar 80 into carriage frame 14, where they are guided in channel sections 90 (see FIG. 2*a*).

As seen in FIG. 3, to connect conduits 88 to valve tubes 70, valve cap 74 is removed from the end 72 of the valve tube, and the free end of the conduits 88 are simply inserted over their associated valve tube end 72. This end may have a flange 92 formed thereon, in the conventional manner, to create a substantially airtight seal with the tube.

By this arrangement, when air reservoirs 82 on carriage handle 80 are squeezed, air pressure in the air reservoirs 66 and thus in bellows 58 is increased to expand bellows and actuate the limbs or arms 16, 18. As each of the arm-actuating mechanisms are independent of each other, the arms can be separately operated. In addition, since the air reservoirs in the carriage handles and the doll's body are in communication with each other and, with the air bellows form a closed air circuit, the doll's limbs can be actuated from either the accessory, i.e., the carriage handle or by squeezing the doll's body itself.

Accordingly, it is seen that a relatively simply constructed toy doll and accessory combination is provided which enables the user to actuate the doll's limbs either by squeezing a portion of the doll's body or by operating a separate accessory. The doll's limbs may be moved when the doll is connected to the accessory either from the accessory or by squeezing the doll itself, thereby greatly increasing the play value of the toy. In addition, it is noted that while the illustrative embodiment of the invention has been described to show the doll's arms 16, 18 actuated by the pressure responsive mechanisms of the invention, it is understood that the legs of the doll could instead of, or in addition to, the arms be actuated in the same way. Thus, for example, if it were desired that the arms remain stationary and the legs move, the mechanisms illustrated in FIG. 3 would simply be connected in the doll's legs rather than in its arms. Alternatively, if all of the limbs were to be operable, duplicate air responsive mechanisms of the type shown in FIG. 3 would be provided within the doll's body connected to the doll's legs.

Although an illustrative embodiment of the invention has been described herein with reference to the accompanying drawings, it is to be understood that the invention is not limited to that precise embodiment and that various changes and modifications may be effected therein by one skilled in the art without departing from the scope or spirit of this invention.

What is claimed is:

1. A combination doll and accessory comprising a doll body having a torso and at least one articulated limb mounted in the body for movement relative to the body's torso; a pressure responsive actuator in said body connected to said at least one limb for moving the limb relative to the torso upon application of fluid pressure thereto; a flexible fluid reservoir located in said body in fluid communication with said actuator whereby compression of said reservoir will cause application of pressure to said actuator and movement of said at least one limb; said reservoir having an outlet opening to the exterior of the doll's body and valve means for selectively opening and closing said outlet opening; an accessory for said doll including a second fluid reservoir and means for connecting said second reservoir to the reservoir in the doll's body, through said valve means, whereby said limb may be selectively actuated by application of pressure to the reservoir in the dolls's body or to said second reservoir.

2. The combination as defined in claim 1 wherein said doll has a plurality of articulated limbs mounted therein for movement relative to the doll's body, separate pressure responsive actuators in the body respectively connected to said limbs, and separate flexible fluid reservoirs in said body respectively connected to said separate actuators, said reservoirs each having an outlet opening to the exterior of the doll's body and valve means for selectively opening and closing said outlet opening; said accessory for the doll including a plurality of independent fluid reservoirs and separate means associated with each of said accessory reservoirs for connecting said accessory reservoirs to respective reservoirs in the doll's body whereby said limbs may be selectively and independently actuated from said accessory.

3. The combination as defined in claim 1 wherein said actuator is an air bellows.

4. The combination as defined in claim 3 wherein said body includes a rigid mounting block and said at least one limb is pivotally mounted on said block and includes a crank operatively connected thereto, said crank being pivotally connected to said bellows whereby expansion of said bellows upon application of pressure to either of said reservoirs cause pivotal movement of said at least one limb.

5. The combination as defined in any one of claims 1, 2, 3, or 4 wherein said accessory is a toy carriage having a handle bar, said second reservoir being mounted on said handle bar and said connecting means being a flexible tube in fluid communication with said second reservoir.

6. A combination doll and doll accessory comprising a body having at least one articulated body portion mounted for movement relative to the body's torso, air bellows mounted in said body and connected to said articulated body portion, a flexible air reservoir mounted in the doll's body and connected in fluid communication with said bellows to expand said bellows for moving said articulated body portion upon application of squeezing pressure to said body adjacent said reservoir, a doll's accessory and means on said accessory, selectively operably connection to said reservoir for selectively increasing air pressure in said reservoir from a remote location on said accessory to expand said bellows whereby said articulated body portion may be moved either upon application of pressure to the doll's body or upon activation of said means on the accessory.

7. A combination doll and accessory comprising a body having at least one articulated body portion mounted for movement relative to the body's torso, first means in said body for moving said articulated body portion upon application of pressure to said body, said first means comprising an air bellows connected to said articulated body portion and a flexible air reservoir connected in fluid communication to said bellows whereby application of pressure to said reservoir expands the bellows and causes movement of said articulated body portion; said air reservoir in the doll's body having an outlet opening therein and valve means for selectively opening and closing the outlet opening; a doll's accessory and second means on said accessory, selectively operably connected to said first means upon application of pressure to said second means whereby said articulated body portion may be moved upon application of pressure to either the doll's body or to said second means; said second means comprising a second air reservoir, mounted on said accessory and conduit means connecting said second reservoir to said first reservoir through said valve means.

8. The combination as defined in claim 7 wherein said accessory is a toy carriage.

* * * * *